US008188785B2

(12) United States Patent
Iacob et al.

(10) Patent No.: US 8,188,785 B2
(45) Date of Patent: May 29, 2012

(54) MIXED-MODE CIRCUITS AND METHODS OF PRODUCING A REFERENCE CURRENT AND A REFERENCE VOLTAGE

(75) Inventors: Radu H. Iacob, Santa Clara, CA (US); Marian Badila, San Jose, CA (US)

(73) Assignee: Semiconductor Components Industries, LLC, Phoenix, AZ (US)

( * ) Notice: Subject to any disclaimer, the term of this patent is extended or adjusted under 35 U.S.C. 154(b) by 244 days.

(21) Appl. No.: 12/700,329

(22) Filed: Feb. 4, 2010

(65) Prior Publication Data

US 2011/0187447 A1 Aug. 4, 2011

(51) Int. Cl.
*G05F 1/10* (2006.01)

(52) U.S. Cl. ..... 327/543

(58) Field of Classification Search ..... 323/315, 323/316, 317; 327/534, 535, 537, 538, 543
See application file for complete search history.

(56) References Cited

U.S. PATENT DOCUMENTS

| | | | |
|---|---|---|---|
| 4,096,430 | A | 6/1978 | Waldron |
| 4,127,783 | A | 11/1978 | Alaspa |
| 4,158,804 | A | 6/1979 | Butler et al. |
| 4,498,040 | A | 2/1985 | Tatsushi et al. |
| 4,559,694 | A | 12/1985 | Yoh et al. |
| 4,723,108 | A | 2/1988 | Murphy et al. |
| 4,812,681 | A | 3/1989 | Pumphrey |
| 4,814,686 | A | 3/1989 | Watanabe |
| 5,117,177 | A | 5/1992 | Eaton, Jr. |
| 5,124,632 | A | 6/1992 | Greaves |
| 5,315,230 | A | 5/1994 | Cordoba et al. |
| 5,376,935 | A | 12/1994 | Seligson |
| 5,394,359 | A | 2/1995 | Kowalski |
| 5,493,141 | A | 2/1996 | Ricco et al. |
| 5,629,612 | A | 5/1997 | Schaffer |
| 5,739,682 | A | 4/1998 | Kay |
| 5,745,000 | A | 4/1998 | Boerstler et al. |
| 5,901,085 | A | 5/1999 | Kramer et al. |
| 5,910,914 | A | 6/1999 | Wang |
| 5,952,946 | A | 9/1999 | Kramer et al. |
| 5,990,816 | A | 11/1999 | Kramer et al. |
| 6,014,044 | A | 1/2000 | Kramer et al. |
| 6,091,286 | A | 7/2000 | Blauschild |

(Continued)

OTHER PUBLICATIONS

Blauschild, R.A, Tucci, P.A., Muller, R.S., Meyer, R.G., A New NMOS Temperature-Stable Voltage Reference, IEEE Journal of Solid-State Circuits, vol. SC-13, No. 6, Dec. 1978.

(Continued)

*Primary Examiner* — Jeffrey Zweizig
(74) *Attorney, Agent, or Firm* — Paul J. Polansky

(57) ABSTRACT

In an embodiment, a circuit includes a first transistor having a first current electrode, a control electrode, and a second current electrode coupled to a power supply terminal. The circuit further includes a resistive element having a first terminal coupled to the control electrode of the first transistor and a second terminal coupled to the power supply terminal. The circuit also includes a feedback circuit for providing a first current to the first control electrode of the first transistor and for preserving substantially the first current related to a voltage at the control electrode of the first transistor, through the resistive element. The feedback circuit includes an output terminal for providing an output signal in response to a voltage at the control electrode of the first transistor. In an embodiment, the first transistor is a floating-gate device with programmable threshold voltage.

22 Claims, 7 Drawing Sheets

U.S. PATENT DOCUMENTS

| | | | | |
|---|---|---|---|---|
| 6,215,352 | B1 | 4/2001 | Sudo | |
| 6,297,689 | B1 | 10/2001 | Merrill | |
| 6,414,536 | B1 | 7/2002 | Chao | |
| 6,441,680 | B1 | 8/2002 | Leung et al. | |
| 6,667,653 | B2 | 12/2003 | Kronmueller et al. | |
| 6,737,909 | B2 | 5/2004 | Jaussi et al. | |
| 6,744,277 | B1 | 6/2004 | Chang et al. | |
| 6,768,371 | B1 | 7/2004 | Layton et al. | |
| 6,798,278 | B2 | 9/2004 | Ueda | |
| 6,914,831 | B2 | 7/2005 | Di Iorio | |
| 6,919,753 | B2 | 7/2005 | Wang et al. | |
| 6,970,037 | B2 | 11/2005 | Sakhuja et al. | |
| 7,034,603 | B2 | 4/2006 | Brady et al. | |
| 7,038,530 | B2 * | 5/2006 | Chou | 327/543 |
| 7,042,205 | B2 | 5/2006 | Tseng et al. | |
| 7,109,785 | B2 * | 9/2006 | Derksen | 327/543 |
| 7,149,123 | B2 | 12/2006 | Georgescu et al. | |
| 7,245,536 | B1 | 7/2007 | Poenaru et al. | |
| 7,288,985 | B2 | 10/2007 | Serrano et al. | |
| 7,372,316 | B2 | 5/2008 | Chatterjee et al. | |
| 2001/0014035 | A1 | 8/2001 | Briner | |
| 2002/0036488 | A1 | 3/2002 | Ueda | |
| 2002/0060600 | A1 | 5/2002 | Ueda | |
| 2003/0058694 | A1 | 3/2003 | Marotta et al. | |
| 2003/0146785 | A1 | 8/2003 | Ueda | |
| 2005/0046469 | A1 | 3/2005 | Geissler | |
| 2005/0052223 | A1 | 3/2005 | Sakhuja et al. | |
| 2007/0109876 | A1 | 5/2007 | Umezawa | |
| 2007/0241809 | A1 | 10/2007 | Kothandaraman et al. | |
| 2008/0048900 | A1 | 2/2008 | Voicu et al. | |
| 2008/0150502 | A1 | 6/2008 | Migliavacca | |
| 2008/0239825 | A1 | 10/2008 | Yamada | |

OTHER PUBLICATIONS

Hirobumi Watanabe, Member, IEEE, Shunsuke Ando, Hideyuki Aota, Masanori Dainin, Yong-Jin Chun, and Kenji Taniguchi, Fellow, IEEE, CMOS Voltage Reference Based on Gate Work Function Differences in Poly-Si Controlled by Conductivity Type and Impurity Concentration, IEEE Journal of Solid-State Circuits, vol. 38, No. 6, Jun. 2003.

Actions on the Merits for co-pending U.S. Appl. No. 12/700,290, filed Feb. 4, 2010 and U.S. Appl. No. 12/703,842, filed Feb. 11, 2010.

* cited by examiner

MIXED-MODE CIRCUITS AND METHODS OF PRODUCING A REFERENCE CURRENT AND A REFERENCE VOLTAGE

CROSS-REFERENCE TO RELATED APPLICATIONS

This application is related to co-pending U.S. patent application Ser. No. 12/700,290 filed on Feb. 4, 2010, entitled "CURRENT-MODE PROGRAMMABLE REFERENCE CIRCUITS AND METHODS THEREFOR,". Further, this application is related to co-pending U.S. patent application Ser. No. 12/703,842 filed on Feb. 11, 2010, entitled "CIRCUITS AND METHODS OF PRODUCING A REFERENCE CURRENT OR VOLTAGE,".

FIELD

The present disclosure is generally related to reference circuits and methods of producing a reference current and a reference voltage. More particularly, the present disclosure relates to mixed-mode circuits that are configurable to produce a reference current and a reference voltage.

BACKGROUND

Current and voltage references are building blocks used in many electronic devices. With increasing numbers of portable electronic devices and with increasing demand for reduced power consumption, demand for low-power, high precision reference circuitry to provide stable reference currents, reference voltages, or both, has increased.

Programmable references based on floating-gate technology gained popularity during the last decade. Thus, programmable floating-gate devices can be used to provide adjustable voltages or currents in a continuous range of values. A floating-gate transistor, for example, can be programmed to produce a reference voltage by tunneling a controlled amount of electric charge onto the floating-gate, which charge is stored on the capacitor associated with the floating-gate. The threshold voltages of such programmed floating-gate transistors are stable or relatively constant for a wide range of supply voltages and temperatures, providing means for implementing a voltage reference or a current reference.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of reference circuits are described below that are configurable to produce a reference current. As used herein, the term "configurable" includes device sizing, including selection of resistances and controlling width and length ratios of transistors. In some instances, the term "configurable" also refers to programming of charge stored on floating gates of appropriately sized floating-gate transistors.

Embodiments of the reference circuits apply a gate-to-source voltage of a first MOS transistor across a resistor to generate a first reference current ($I_{REF1}$) that can be used to bias the transistor through a feedback loop. A floating-gate implementation of the first transistor provides the ability to program the first reference current ($I_{REF1}$). Embodiments of the reference circuits also include a second MOS transistor that has the gate electrode connected to a gate electrode of the first transistor and a source electrode connected to a second resistor. A difference between the gate-to-source voltages of the first and second transistors can be applied across the second resistor to generate a second reference current ($I_2$). The second reference current can be sourced or sunk through the drain electrode of the second transistor and mirrored at the output to provide an output reference signal ($I_{REF}$) and/or sourced on a third resistor to generate a reference voltage ($V_{REF}$). A floating-gate implementation of the second transistor provides the ability to program the second reference current ($I_2$). In some embodiments, a third floating-gate transistor can replace the first resistor and/or can be used to program the first and second floating-gate transistors.

Figure 1:
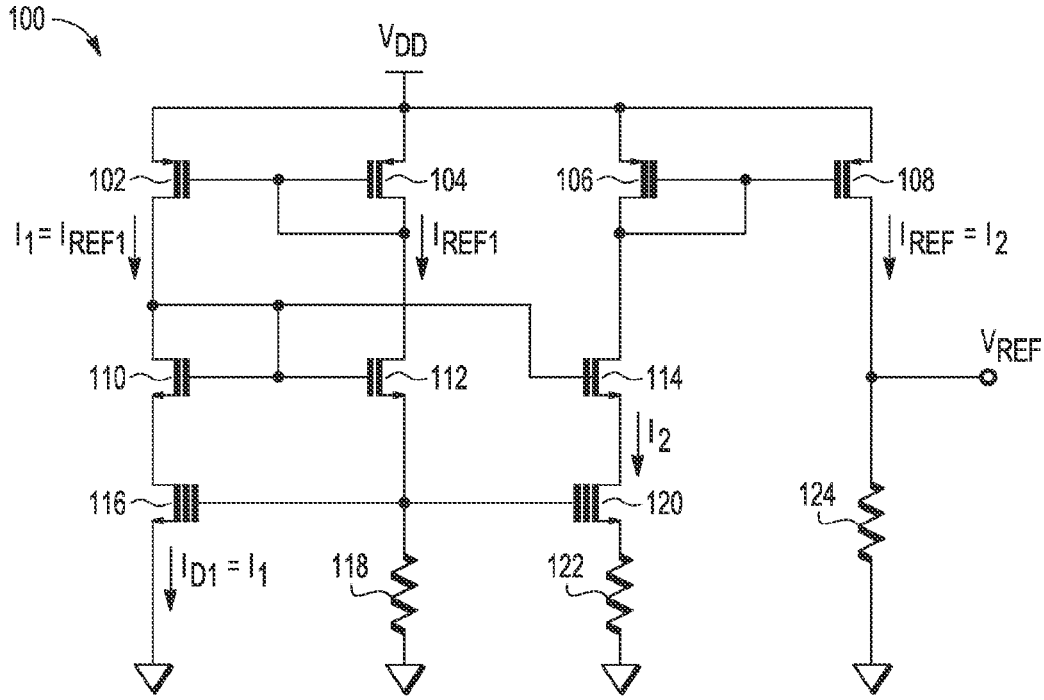
FIG. 1 is a schematic diagram of an embodiment of a reference circuit including programmable floating-gate transistors to provide a reference current and a reference voltage.

FIG. 1 is a schematic diagram of an embodiment of a reference circuit 100 including programmable floating-gate transistors 116 and 120 to provide a reference voltage. Circuit 100 includes PMOS transistors 102, 104, 106, and 108, NMOS transistors 110, 112, and 114, N-channel floating-gate transistors 116 and 120, and resistors 118, 122, and 124.

PMOS transistor 102, NMOS transistor 110, and floating-gate transistor 116 cooperate to form a first current path to carry a first current ($I_1$). PMOS transistor 102 includes a source electrode connected to a first power supply terminal labeled "$V_{DD}$", a gate electrode, and a drain electrode. NMOS transistor 110 includes a drain electrode connected to the drain electrode of PMOS transistor 102, a gate electrode connected to the drain electrode of transistor 102, and a source electrode. Floating-gate transistor 116 includes a drain electrode connected to the source electrode of NMOS transistor 110, a gate electrode, and a source electrode connected to a second power supply terminal.

PMOS transistor 104, NMOS transistor 112, and resistor 118 cooperate to form a second current path to carry a first reference current ($I_{REF1}$). Feedback from the second current path to the first current path through NMOS transistors 110 and 112 biases the floating-gate transistor 116. PMOS transistor 104 includes a source electrode connected to the first power supply terminal, a gate electrode connected to the gate electrode of PMOS transistor 102, and a drain electrode connected to the gate electrodes of the PMOS transistors 102 and 104. NMOS transistor 112 includes a drain electrode connected to the drain electrode of PMOS transistor 104, a gate electrode connected to the gate and drain electrodes of NMOS transistor 110, and a source electrode connected to a first terminal of resistor 118, which includes a second terminal connected to the second power supply terminal.

PMOS transistor 106, NMOS 114, floating-gate transistor 120, and resistor 122 cooperate to form a third current path to carry a second current ($I_2$), which is related to the first reference current ($I_{REF1}$). PMOS transistor 106 includes a source electrode connected to the power supply terminal, a gate electrode, and a drain electrode connected to the gate electrode. NMOS transistor 114 includes a drain electrode connected to the drain electrode of PMOS transistor 106, a gate electrode connected to the gate electrodes of NMOS transistors 110 and 112, and a source electrode. Floating-gate transistor 120 includes a drain electrode connected to the source electrode of NMOS transistor 114, a gate electrode connected to the first terminal of resistor 118 and to the gate electrode of floating-gate transistor 116, and a source terminal connected to a first terminal of resistor 122. Resistor 122 also includes a second terminal connected to the second power supply terminal.

PMOS transistor 108 and resistor 124 cooperate to provide an output current path to carry a reference current ($I_{REF}$) that is proportional to the second current ($I_2$) and which can be sourced on resistor 124 to produce a reference voltage. In an example, the third current path and the output current paths provide gain and mirror stages to sink the second current ($I_2$) through the drain electrode of the second transistor 120 and to mirror the second current ($I_2$) at PMOS transistor 108 to provide an output reference signal ($I_{REF}$) and/or to source the reference current on a third resistor to generate a reference voltage (VREF). PMOS transistor 108 includes a source electrode connected to the power supply terminal, a gate electrode connected to the gate and drain electrodes of PMOS transistor 106, and a drain electrode connected to a first terminal of resistor 124, which includes a second terminal connected to the second power supply terminal.

Circuit 100 uses the difference between the gate-to-source voltages of transistors 116 and 120 connected in common source configuration and having a common gate to establish the second current ($I_2$). Transistor 116 is self-biased by resistor 118 through the feedback loop provided by NMOS transistor 112 and PMOS transistors 102 and 104, which establish the first current ($I_1$) through transistor 116. If transistors 102 and 104 are equally sized, the first current ($I_1$) equals the first reference current ($I_{REF1}$). The resistor 122 acts as a reference resistor. The difference between the gate-to-source voltage of floating-gate transistor 116 and the gate-to-source voltage of floating-gate transistor 120, across resistor 122, generates the second current ($I_2$), which is mirrored by PMOS transistor 108 to provide the reference current ($I_{REF}$).

Floating-gate transistor 116 provides the ability to program the threshold voltage and to program the first reference current ($I_{REF1}$). Floating-gate transistor 120 provides the ability to program its threshold voltage and thereby to program the second reference current ($I_2$).

Circuit 100 is a mixed-mode reference circuit that can be understood to have two stages: a voltage-mode bootstrap stage and a current-mode stage. The voltage-mode bootstrap stage includes floating-gate transistor 116, resistor 118, and the self-biasing feedback loop of transistors 110 and 112 and PMOS transistors 102 and 104. The current-mode stage includes floating-gate transistor 120, reference resistor 122, and additional cascoding and mirroring devices, including or namely transistor 114 and PMOS transistors 106 and 108.

In the illustrated embodiment, the voltage ($V_{DD}$) on the first power supply terminal is a more-positive power supply voltage relative to the second power supply terminal, with a nominal value of 2.0 volts with respect to ground. A current mirror formed by transistors 102 and 104 mirrors the first reference current ($I_{REF1}$) through the first current path. If transistors 102 and 104 have approximately equal sizes, then the first current ($I_1$) is approximately equal to the first reference current ($I_{REF1}$). The first reference current ($I_{REF1}$) is established as the current that flows through resistor 118 to set the gate-to-source voltage ($V_{GS}$) of transistor 116, to a value that allows the first current ($I_1$) to flow through the drain-to-source path of transistor 116. If the threshold voltage of transistor 116 increases as more charge is programmed on the floating gate, then the first reference current ($I_{REF1}$) increases until the gate-to-source voltage ($V_{GS}$) of transistor 116 rises enough to again conduct the first current ($I_1$) through the drain-to-source current path. In this way, the amount of charge on the floating-gate of transistor 116 establishes a stable current reference.

The first reference current ($I_{REF1}$) also sets the voltage on the gate electrode of transistor 120. Transistor 114 acts as a source follower, and the voltage at the source electrode of transistor 114 follows the voltage at the gate electrode, with approximately a nominal threshold voltage drop. Thus, the voltage at the drain of transistor 120 is approximately equal to the voltage at the drain of transistor 116. In this way, the value of the second current ($I_2$) is set based on the gate voltage of transistor 120 and the value of resistor 122, which allows the second current ($I_2$) to be different from the first current ($I_1$) based on the value of resistor 122 and the charge stored on the floating-gate of transistor 120. The current mirror represented by PMOS transistors 106 and 108 mirrors the second current ($I_2$) to generate the reference current ($I_{REF}$).

Figure 2:
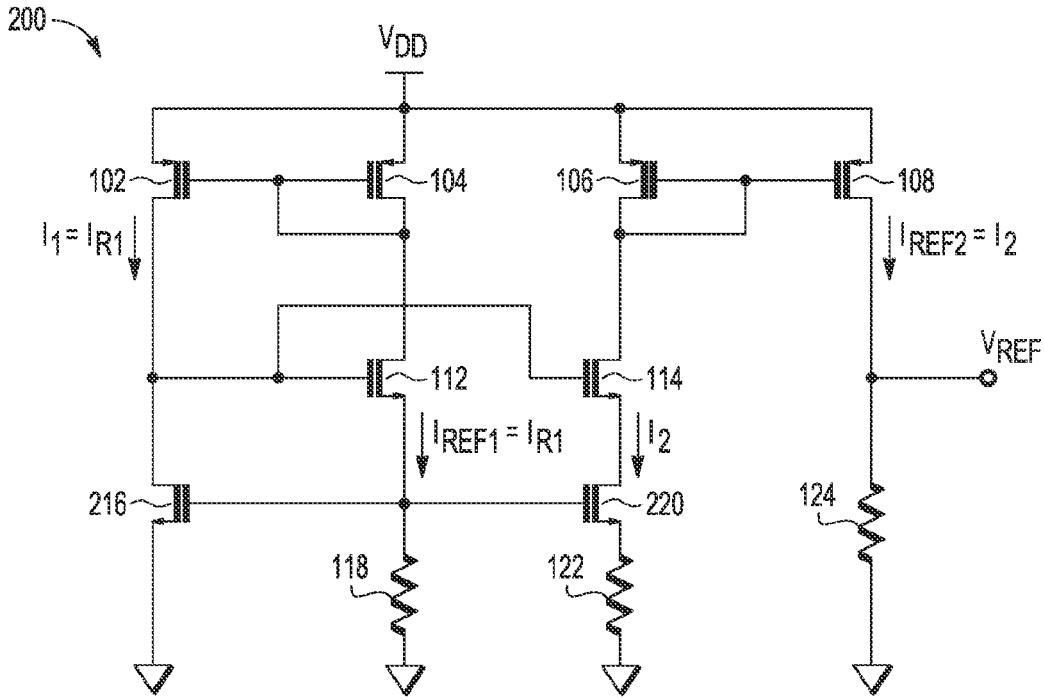
FIG. 2 is a schematic diagram of a second embodiment of a reference circuit to provide a reference current and a reference voltage.

FIG. 2 is a schematic diagram of a second embodiment of a reference circuit 200 to provide a reference voltage. Circuit 200 is a variation of circuit 100 in FIG. 1, where transistor 110 is omitted, and floating-gate transistors 116 and 120 are replaced with NMOS transistors 216 and 220.

Circuit 200 includes NMOS transistor 216 including a drain electrode connected to the drain electrode of PMOS transistor 102 and to the gate electrode of NMOS transistor 112. NMOS transistor 216 further includes a gate electrode connected to the first terminal of resistor 118 and to the gate electrode of NMOS transistor 220, and includes a source electrode connected to the second power supply terminal.

NMOS transistor 112 includes a drain electrode connected to the drain and gate electrodes of PMOS transistor 104, a gate electrode connected to the drain electrodes of PMOS and NMOS transistors 102 and 216, and a source electrode connected to the gate electrodes of NMOS transistors 216 and 220 and to the first terminal of resistor 118.

NMOS transistor 220 includes a drain electrode connected to a source electrode of NMOS transistor 114. Further, NMOS transistor 220 includes a gate electrode connected to the gate electrode of NMOS transistor 216, to the source electrode of NMOS transistor 112, and to the first terminal of resistor 118. NMOS transistor 220 also includes a source electrode connected to a first terminal of resistor 122.

NMOS transistor 114 includes a drain electrode connected to the drain electrode of PMOS transistor 106, a gate electrode connected to the gate electrode of NMOS transistor 112 and to the drain electrodes of PMOS and NMOS transistors 102 and 216, and a source electrode connected to the drain electrode of NMOS transistor 120.

In operation, if transistors 102 and 104 have approximately equal sizes, then the first current ($I_1$) is approximately equal to the first reference current ($I_{REF1}$), which is equal to the current flowing through resistor 118 (i.e., $I_{R1}$). When transistor 216 is off, the voltage increases at the drain electrode of transistor 216, turning on transistor 112. The first reference current ($I_{REF1}$) is established as the current that flows through resistor 118 to set the gate-to-source voltage ($V_{GS}$) of transistor 216, to a value that allows the first current ($I_1$) to flow through the drain-to-source path of transistor 216. Since the threshold voltage of transistor 216 is fixed, the first reference current ($I_{REF1}$) increases until the gate-to-source voltage ($V_{GS}$) of transistor 116 rises enough to conduct the first current ($I_1$) through the drain-to-source current path. The voltage level at the drain electrode of transistor 216 decreases to a level that maintains transistors 112 and 114 in an active state. In this way, the threshold voltage of transistor 116 and the value of resistor 118 establish a stable current reference.

The first reference current ($I_{REF1}$) also sets the voltage on the gate electrode of transistor 120. Transistor 114 acts as a source follower, and the voltage at the source electrode of transistor 114 follows the voltage at the gate electrode, at approximately one threshold voltage below. Thus, the voltage at the drain electrode of transistor 220 is approximately equal to the voltage at the drain electrode of transistor 216. In this way, the value of the second current ($I_2$) is set based on the gate voltage of transistor 220 and the value of resistor 122, which allows the second current ($I_2$) to be different from the first current ($I_1$) based on the value of resistor 122 and the threshold voltage of transistor 220. The current mirror represented by PMOS transistors 106 and 108 mirrors the second current ($I_2$) to generate the reference current ($I_{REF2}$).

In this embodiment, the circuit 200 is a mixed-mode reference circuit that can be understood to have the same two stages as circuit 100: a voltage-mode bootstrap stage and a current-mode stage. The voltage-mode bootstrap stage includes transistor 216, resistor 118, and the self-biasing feedback loop of transistor 112 and PMOS transistors 102 and 104. The current-mode stage includes transistor 220, reference resistor 122, and additional cascoding and mirroring devices, such as transistor 114 and PMOS transistors 106 and 108. In general, the voltage-mode stage is a bootstrap reference that can be used to extract the source-to-gate voltage of transistor 216 across resistor 118. The bootstrap reference configuration is depicted in FIG. 3.

Figure 3:
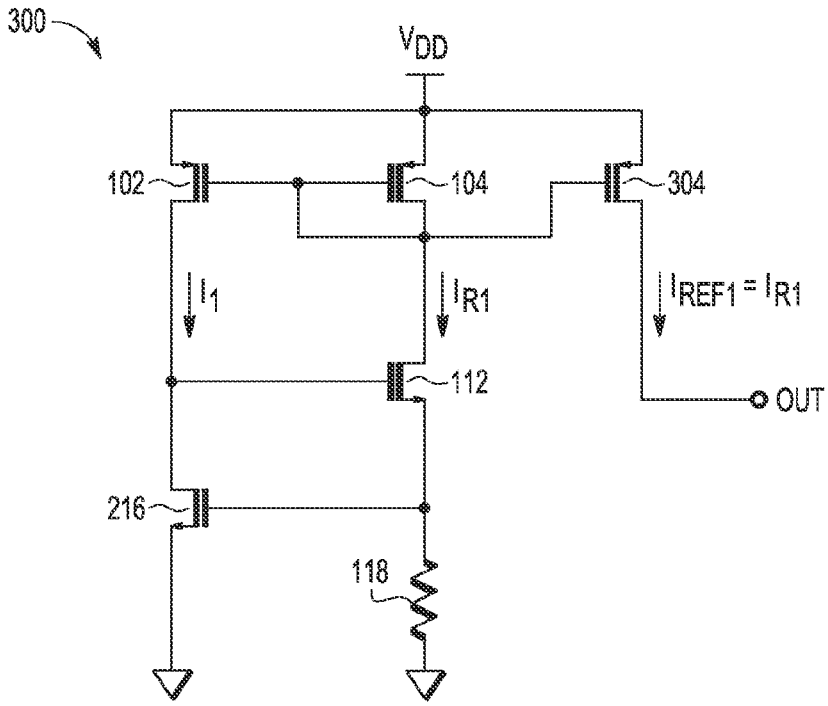
FIG. 3 is a schematic diagram an embodiment of a bootstrap voltage reference circuit portion of the reference circuit depicted in FIG. 2.

FIG. 3 is a schematic diagram an embodiment of a bootstrap voltage reference circuit 300 of the reference circuit 200 depicted in FIG. 2. The bootstrap voltage reference circuit 300 includes PMOS transistors 102 and 104, NMOS transistors 112 and 216, and resistor 118 configured as described with respect to FIGS. 1 and 2 above. In an embodiment, resistor 118 can replaced with a configurable switched impedance or a programmable floating-gate device or transistor. Further, circuit 300 includes PMOS transistor 304 including a source electrode connected to the power supply terminal, a gate electrode connected to the gate and drain electrodes of PMOS transistor 104, and a drain terminal. The PMOS transistor 304 provides an output current path to carry the reference current ($I_{REF1}$), which is proportional to the current ($I_{R1}$) through PMOS transistor 104, transistor 112 and resistor 118.

It is possible to configure the current in circuit 300 by changing the size of resistor 118 and transistor 216. The relationship between the reference current ($I_{REF}$) or the reference voltage ($V_{REF}$) and the device sizes can be determined by circuit simulation or analytically using circuit analysis techniques, both of which are well-known to those of ordinary skill in the art. For example, an analysis of the operating point of circuit 300 will be described below.

For the degenerate case where the circuit 300 is biased such that the gate-to-source voltage ($V_{GS}$) is less than the threshold voltage, the DC operating point is defined as shown in the equation below:

$$I_1=0 \tag{1}$$

The DC operating point of the circuit 300 can be more precisely described by the following equations. For the circuit 300 biased such that the gate-to-source voltage is greater than the threshold voltage of transistor 216, the DC operating point is defined as shown in Equation 1 below:

$$V_{GS216} = V_{Th216} + \sqrt{\frac{2I_1 L_{216}}{\mu_n C_{ox} W_{216}}} \tag{2}$$

where the variables represent the gate-to-source voltage ($V_{GS216}$), the threshold voltage ($V_{Th216}$), the first current ($I_1$), and parameters of transistor 216, including length (L), width (W), oxide capacitance ($C_{ox}$) and the average electron mobility factor ($\mu_n$).

Thus, the gate-to-source voltage of transistor 216 is related to the first current ($I_1$). If transistors 102 and 104 have substantially the same size, the first current ($I_1$) is substantially equal to the current ($I_{R1}$) through PMOS transistor 104 and transistor 112, which yields a gate-to-source voltage of transistor 216 as follows:

$$V_{GS216}=R_{118}I_{R1} \tag{3}$$

By substituting this expression of the gate-to-source voltage ($V_{GS216}$) of transistor 216 for $V_{GS216}$ in equation (1), one can determine the value of the current ($I_{R1}$) as a function of the threshold voltage ($V_{Th216}$). The output reference current ($I_{REF1}$) is then proportional to the current ($I_{R1}$) based on the width-to-length ratios between transistors 304 and 104.

At very low bias currents, the source-to-gate voltage of transistor 216 is very close to threshold voltage ($V_{Th216}$), and the first reference current ($I_{REF1}$) is a complementary-to-absolute-temperature (CTAT) current. Thus, when the transistor 216 operates in sub-threshold (i.e., $V_{GS216}<V_{Th216}+2nkT/q$) and, assuming a zero temperature coefficient for resistor 118, the output current ($I_{REF1}$) will reflect the thermal characteristics of the threshold voltage ($V_{Th216}$), exhibiting a CTAT current variation.

When transistor 216 is not operated in sub-threshold (i.e., $V_{GS216}>V_{Th216}+2nkT/q$), then the gate-to-source voltage of transistor 216 is determined as follows:

$$V_{GS216}=V_{Th216}+V_{ov216} \tag{4}$$

where the variable ($V_{ov216}$) represents an overdrive voltage that provides a thermal component, which has a positive temperature coefficient, while the threshold voltage has a negative temperature coefficient. Thus, an operating point exists where the negative and positive temperature coefficient components cancel each other, providing a global zero temperature coefficient (ZTC) at the output.

Figure 4:
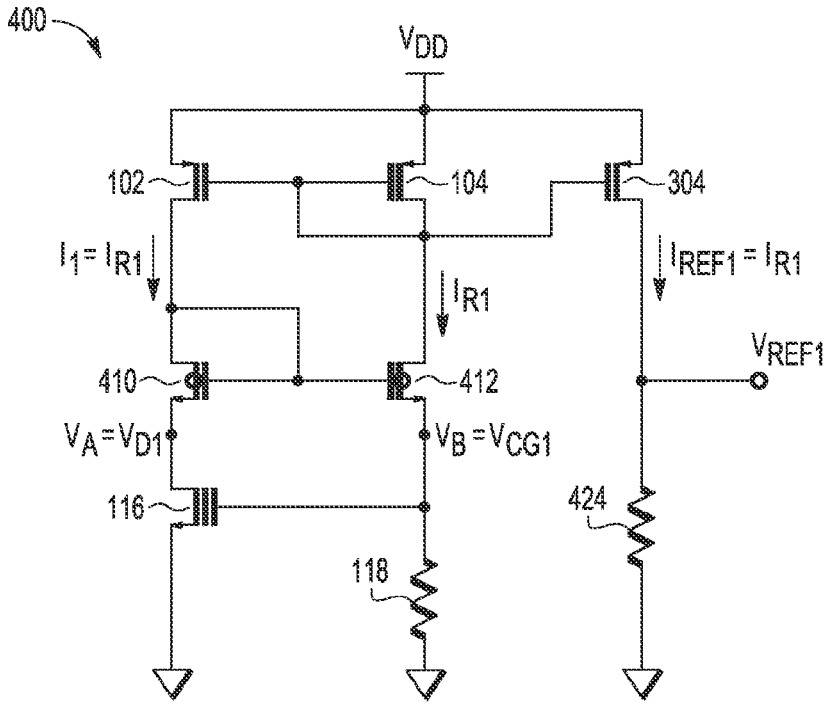
FIG. 4 is a schematic diagram of an embodiment of a programmable bootstrap voltage reference circuit based on the circuit of FIG. 3.

FIG. 4 is a schematic diagram of an embodiment of a programmable bootstrap voltage reference circuit 400 based on the circuit 300 of FIG. 3. Relative to circuit 100 in FIG. 1, in circuit 400, the gain and mirror circuitry including PMOS transistors 106 and 108, transistor 114, floating-gate transistor 120, and resistors 122 and 124 are omitted.

Circuit 400 includes intrinsic or zero-voltage transistors 410 and 412. Transistor 410 include a drain electrode connected to the drain electrode of PMOS transistor 102, a gate electrode connected to the drain electrode, and a source electrode connected to the drain electrode of floating-gate transistor 116. Transistor 412 includes a drain electrode connected to the drain electrode of PMOS transistor 104, a gate electrode connected to the gate electrode of transistor 410, and a source electrode connected to the first terminal of resistor 118 and to the gate electrode of floating-gate transistor 116.

Further, circuit 400 includes transistor 304, as in circuit 300, and a resistor 424. Resistor 424 includes a first terminal connected to the drain electrode of transistor 304 and a second terminal connected to ground. Circuit 400 converts the first reference current ($I_{REF1}$) into an output reference voltage ($V_{REF1}$). The output reference voltage ($V_{REF1}$) is determined by the size of transistor 116, the charge on the floating gate of transistor 116, the size of resistor 118, and the relative sizes of transistors 104 and 304. If transistors 104 and 304 have substantially equal sizes, the first reference current ($I_{REF1}$) is substantially equal to the current ($I_{R1}$). If the transistors 104 and 304 are different sizes, then the first reference current ($I_{REF1}$) is proportional to the current ($I_{R1}$) according to the relative sizes of the transistors 104 and 304.

Figure 5:
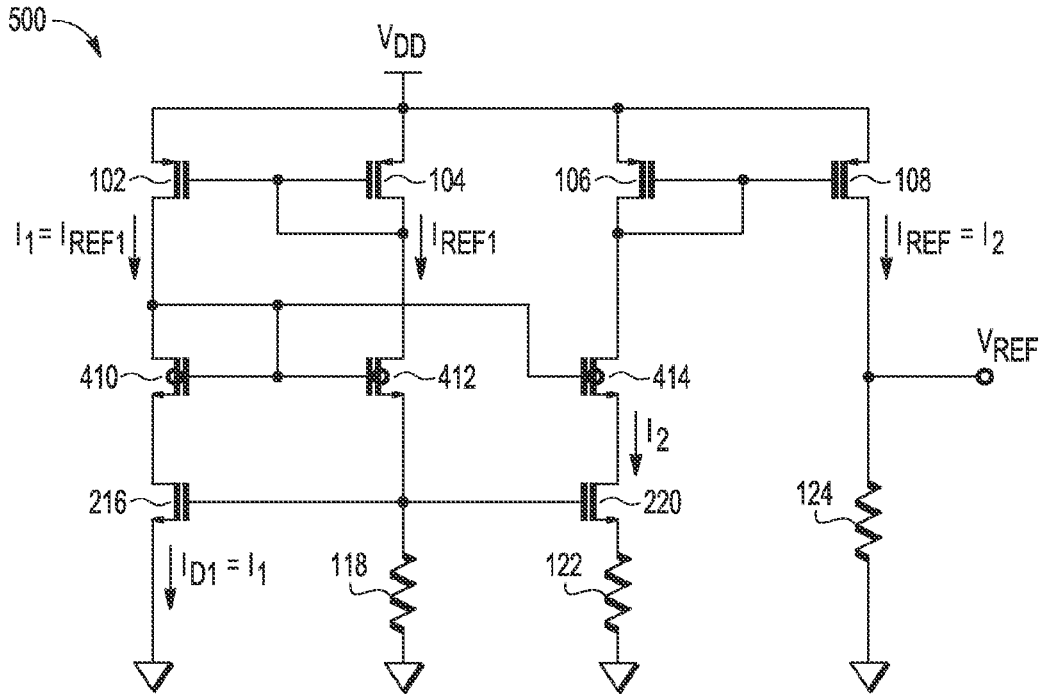
FIG. 5 is a schematic diagram of a third embodiment of a reference circuit to provide a reference current and a reference voltage.

FIG. 5 is a schematic diagram of a third embodiment of a reference circuit 500 to provide a reference current and a reference voltage. The reference circuit 500 includes PMOS transistors 102, 104, 106, and 108, intrinsic transistors 410, 412, and 414, and resistors 118, 122, and 124 configured as in the circuit 100 depicted in FIG. 1, with intrinsic transistors 410, 412, and 414 replacing NMOS transistors 110, 112, and 114. Further, floating-gate transistors 116 and 120 are replaced with NMOS transistors 216 and 220, respectively.

In circuit 500, the first reference current ($I_{REF1}$) is set by the threshold voltage and the physical dimensions of transistor 216 and the value of resistor 118, and the reference current ($I_{REF}$) and the reference voltage ($V_{REF}$) are set by the voltage drop produced by the first reference current ($I_{REF1}$) across resistor 118, the threshold voltage and the physical dimensions of transistor 220, and the value of resistor 122.

Figure 6:
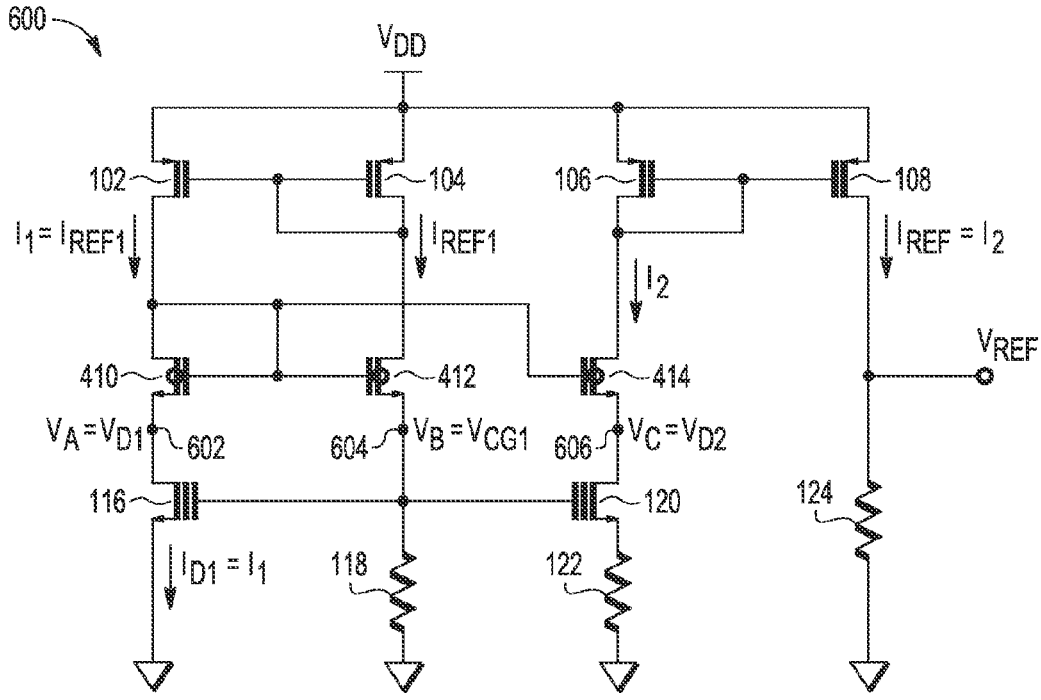
FIG. 6 is a schematic diagram of a fourth embodiment of a reference circuit including programmable floating-gate transistors to provide a reference voltage.

FIG. 6 is a schematic diagram of a fourth embodiment of a reference circuit 600 including programmable floating-gate transistors 116 and 120 to provide a reference voltage. Circuit 600 has the same configuration as circuit 500 in FIG. 5, except that transistors 216 and 220 are replaced with programmable floating-gate transistors 116 and 120.

In this embodiment, the threshold voltages of floating-gate transistors 116 and 120 can be programmed, which alters the voltage at the first terminal at node ($V_B$) 604. Transistors 410, 412, and 414 maintain equal voltage levels at nodes $V_A$ 602, $V_B$ 604, and $V_C$ 606. The reference current ($I_{REF}$) is generated by the gate-to-source voltages $V_{GS116}$ and $V_{GS120}$ of transistors 116 and 120 applied across the resistor 122. When transistors 116 and 120 are identical and are programmed to have threshold voltages such that they operate at equal currents, the voltage drop across resistor 122 depends only on the electric charge on the floating-gates of transistors 116 and 120, thus providing an electrical reference.

Circuit 600 can be programmed such that floating-gate transistors 116 and 120 have equal drain currents and neglecting the substrate effect, it should be appreciated that the reference current ($I_{REF}$) is proportional to the resistance of resistor 122. Further, when the transistors 116 and 120 are operated in sub-threshold and are programmed to have the same current, the resulting voltage is the same as in strong inversion. Thus, the circuit 600 can provide a stable reference current over a wide range of voltages and can operate in low-voltage applications.

In the illustrated embodiment, circuit 600 operates in much the same way as circuit 500 depicted in FIG. 5. However, circuit 600 uses programmable floating-gate transistors 116 and 120, which have programmable voltage thresholds to allow for refinement of the currents ($I_1$, $I_{REF1}$, $I_2$, and $I_{REF}$). Such programming of the voltage thresholds allows for a more precise reference output.

The floating gate transistors used in FIGS. 1, 4, and 6 can be configured by conventional programming and erasing techniques. However, circuits that are particularly useful in more precisely placing desired amounts of charge on the floating gates are described in FIGS. 7 and 8 below.

Figure 7:
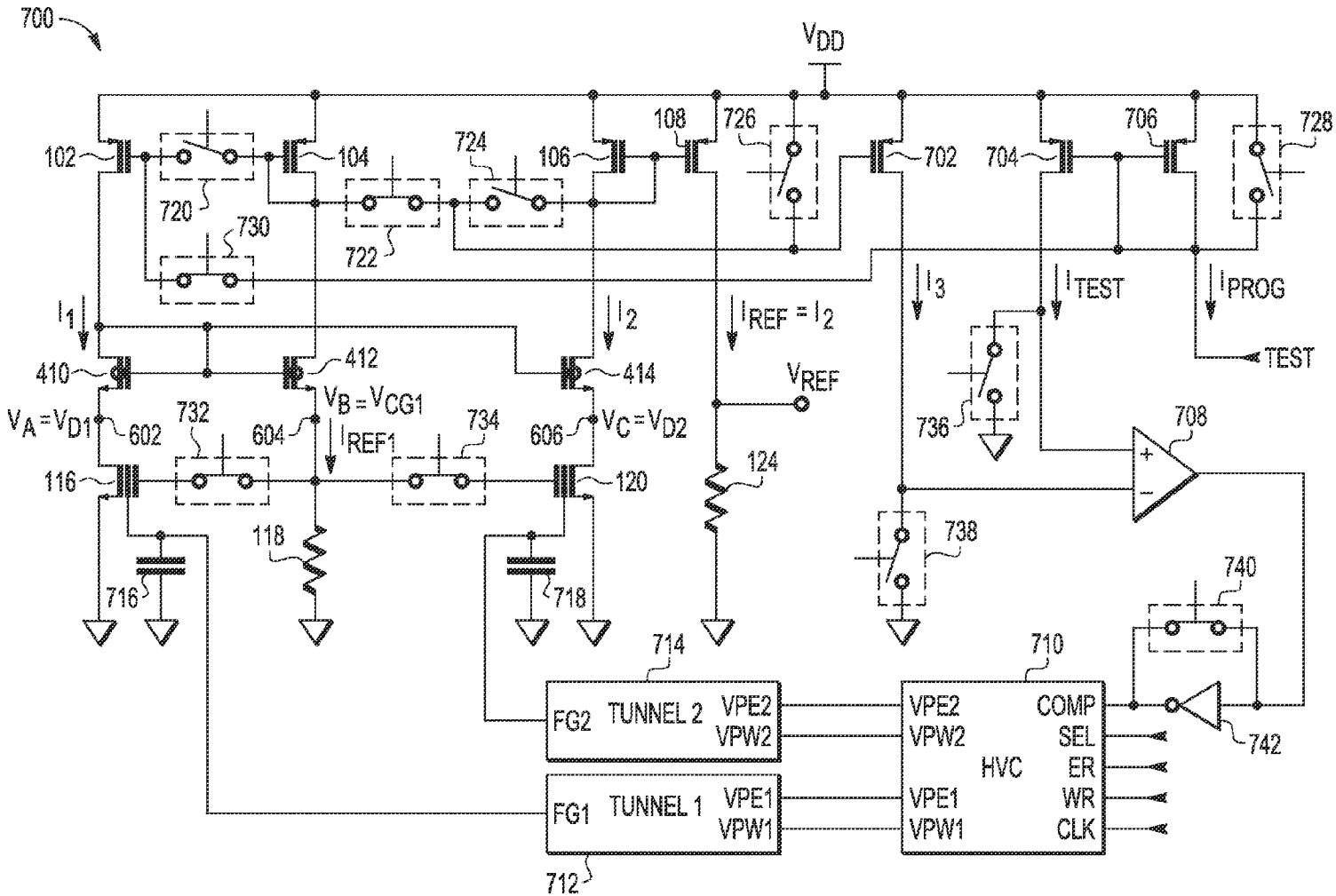
FIG. 7 is a partial block and partial schematic diagram of an embodiment of a circuit including the reference circuit of FIG. 6 and including programming circuitry to configure the reference circuit to provide a reference voltage.

FIG. 7 is a partial block and partial schematic diagram of an embodiment of a circuit 700 including the reference circuit 600 of FIG. 6 and including programming circuitry to configure the reference circuit to provide a reference voltage. In particular, circuit 700 includes switch 720 including a first terminal connected to the gate electrode of PMOS transistor 102 and a second terminal connected to the gate electrode of PMOS transistor 104. Switch 730 includes a first terminal connected to the gate electrode of PMOS transistor 102 and a second terminal connected to gate electrodes of PMOS transistors 704 and 706. Switch 722 includes a first terminal connected to the gate and drain electrodes of PMOS transistor 104 and a second terminal connected to a second terminal of switch 726. Switch 726 also includes a first terminal connected to $V_{DD}$. Switch 724 includes a first terminal connected to the second terminal of switch 722 and a second terminal connected to the gate and drain electrodes of PMOS transistor 106. Switch 732 includes a first terminal connected to the gate electrode of floating-gate transistor 116 and a second terminal connected to a first terminal of resistor 118. Switch 734 includes a first terminal connected to the first terminal of resistor 118 and a second terminal connected to the gate electrode of floating-gate transistor 120.

Circuit 700 further includes PMOS transistors 702, 704, and 706, comparator 708, high voltage controller 710, tunnel circuitry 712 and 714, and inverter 742. PMOS transistor 702 includes a source electrode connected to $V_{DD}$, a gate electrode connected to the second terminal of switch 726, and a drain electrode connected to a first terminal of switch 738 and to a negative input of differential amplifier 708. Switch 738 includes a second terminal connected to ground.

PMOS transistor 704 includes a source electrode connected to $V_{DD}$, a gate electrode connected to the second terminal of switch 730 and a test pin ($V_{TEST}$), and a drain electrode connected to a positive input of the comparator 708 and to a first terminal of switch 736. Switch 736 includes a second terminal connected to ground. The gate electrode of PMOS transistor 704 is also connected to a second terminal of switch 728, which includes a first terminal connected to $V_{DD}$.

PMOS transistor 706 includes a source electrode connected to $V_{DD}$, a gate electrode connected to the gate electrode of PMOS transistor 704, and a drain electrode connected to the gate electrodes of PMOS transistors 704 and 706.

Comparator 708 includes an output to carry a control signal from the amplifier 708 through inverter 742 or through switch 740 to a control input (COMP) of the high voltage controller 710. High voltage controller 710 further includes a select input (SEL), an erase input (ER), a write input (WR), and a clock input (CLK). High voltage controller 710 is responsive to the various inputs to configure the floating-gates of transistors 116 and 120 through tunnel devices 712 and 714, respectively.

Before being programmed, the floating-gate transistors 116 and 120 are characterized by a native state with similar threshold voltages. Transistor 116 is self-biased at a current determined by the level of the native threshold and by the resistor 118. Transistor 120 is substantially identical to transistor 116 and is either off or in sub-threshold, due to the presence of resistor 122.

To produce a reference current, the voltage potential of the floating-gates of transistors 116 and 120 should be programmed such that the floating-gate voltage of transistor 116, represented by capacitor 716, is greater than the floating-gate voltage of transistor 120, represented by capacitor 718.

In read mode, high voltage controller 710 turns on switches 720, 726, 732, 734, 728, 736, 738, and 740 and turns off switches 722, 724, 730. The test current ($I_{TEST}$) branches are disabled through the switches 726 and 728, while the inputs of comparator 708 are coupled to the second power supply terminal (grounded) by switches 736 and 738.

To program transistor 116, a possible programming cycle includes an erase operation followed by a write operation, which may be reflected in variations of the equivalent threshold of transistor 116 as seen from the gate electrode of transistor 116, which translate into different variations of the current ($I_{R1}$) through resistor 118.

The erase procedure involves reconfiguring the switches, such that switches 720, 734, 726, 728, 738, 736, and 740 are on and switches 722, 724, 730, 732 are off. Compared to the read configuration, only switch 732 changed state, because the erase operation is independent of the control loop. At the end of the erase operation, the equivalent threshold voltage of the floating-gate of transistor 116 has a high level, and transistor 116 is off.

The write operation following the erase is controlled by the programming loop, including high voltage controller 710, which turns off switches 720, 724, 726, 728, 736, 738, and 740 and turns on switches 730, 722, 732, and 734. As long as transistor 116 is not conductive, the programming current ($I_{PROG}$) mirrored by PMOS transistor 102 is sourced on transistor 116, pulling up the voltage potential of the drain electrode of transistor 116 and of the gate electrode of intrinsic transistor 412, causing a high current to flow through resistor 118.

During the write operation, the negative electric charge on the floating-gate of transistor 116 is extracted, and the equivalent threshold voltage on the gate electrode decreases. Transistor 116 begins conducting and pulls down the voltage potential of the gate electrode of transistor 412 to a level maintained by the feedback loop including transistors 116, 410 and 412, thus reducing the current ($I_{REF1}$) through resistor 118. When the current ($I_{REF1}$) reaches the level of the test current ($I_{TEST}$) on the drain of PMOS transistor 704, the control signal at the output of differential amplifier 708 disables the high-voltage controller 710 and the write operation is concluded.

The above-described programming technique provides continuous trimming until the target parameter ($I_{REF1}=I_{TEST}$) is achieved, without requiring multiple write pulses such as in program-verify algorithms. In a simplified version of the programming algorithm, the initial ERASE operation can be skipped.

In an alternative programming. sequence, circuit 700 offers the possibility of reversing the programming sequence, by applying first the write cycle to decrease the threshold voltage of transistor 116, and then gradually increasing the threshold voltage through a controlled erase procedure. In some instances, such a sequence may require a pulsed high-voltage erase cycle followed by an evaluation stage, within a repeated cycle (iterative loop) that stops when the desired reference current ($I_{REF}$) is achieved.

To program transistor 120, an erase operation may be followed by a write operation. The programming process may be represented by variations of the equivalent threshold of the transistor 120 as seen from the gate electrode, which translate into variations of the current ($I_2$) through the resistor 122. In a simplified version of the programming procedure, the ERASE operation can be skipped.

High voltage controller 710 controls the switches to configure circuit 700 for the erase operation of transistor 120. In particular, high voltage controller 710 turns on switches 720, 732, 726, 728, 736, 738, and 740 and turns off switches 722, 724, 730, and 734. The erase operation is performed without a control loop (i.e., without using comparator 708), and the duration of the high-voltage cycle can be defined by the programmer. At the end of the erase operation, the equivalent threshold voltage of the floating-gate of transistor 120 has a high level, and transistor 120 is off. As a result, the reference current $I_{REF}=0$.

The write operation following the erase operation is controlled by the programming loop. High voltage controller 710 turns on switches 720, 724, 732, and 734 and turns off switches 722, 726, 728, 730, 736, 738, and 740. During the write operation, the negative electric charge on the floating-gate of transistor 120 is extracted, and the equivalent threshold voltage on the gate electrode decreases, bringing transistor 120 into conduction and producing a non-zero current through resistor 122. The write cycle is stopped automatically when the second current ($I_2$) through resistor 122 reaches the level of the programming current ($I_{PROG}$), which has the same value as in erase for thermal compensation purposes.

As mentioned above, in an alternative programming sequence, transistor 120 can be programmed using a write operation followed by an erase operation. In this alternative sequence, the controlled erase procedure requires a series of high voltage pulses of a predetermined duration, until the desired level of programmed current is achieved.

Figure 8:
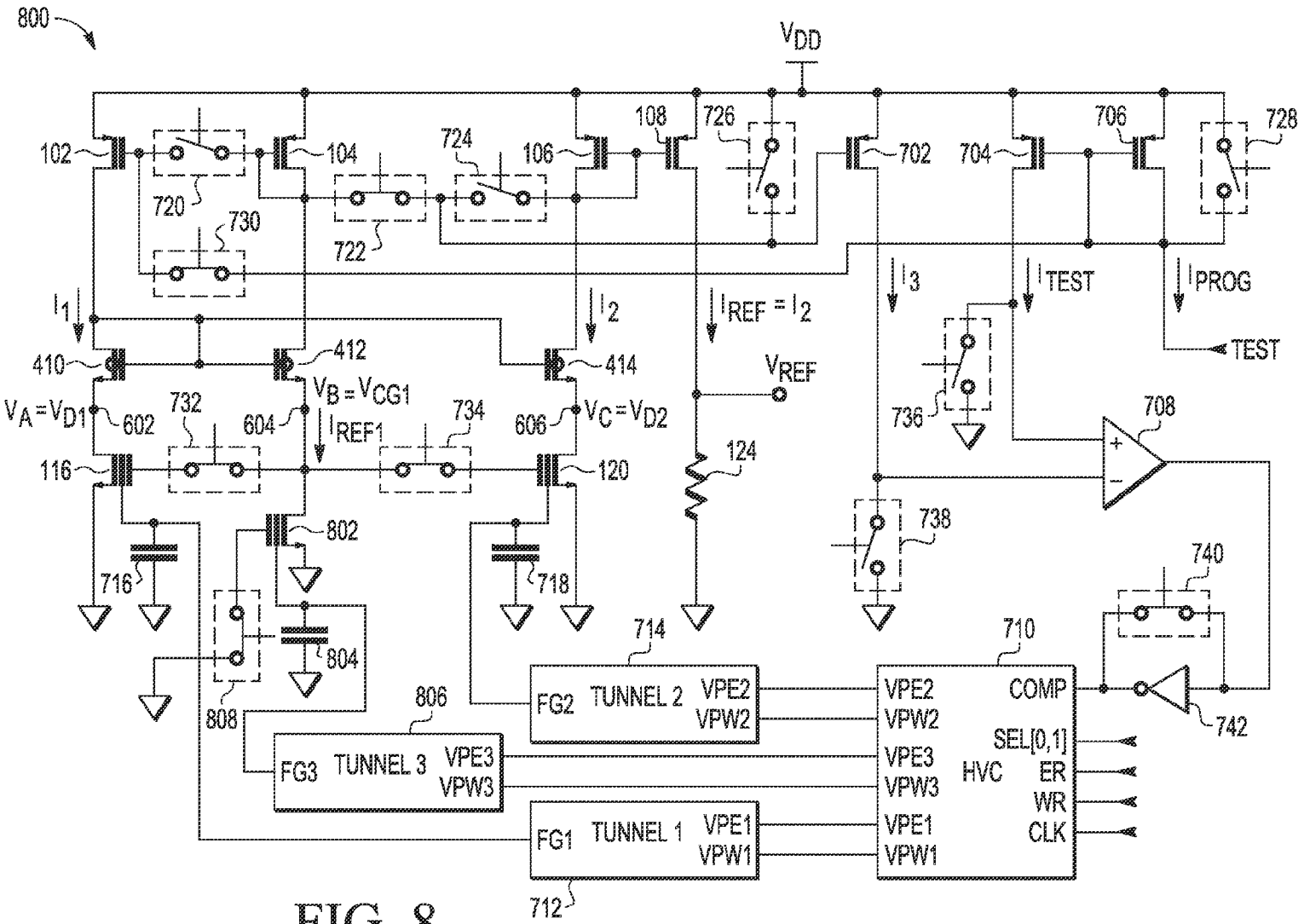
FIG. 8 is a partial block and partial schematic diagram of a circuit including the circuit of FIG. 7 and including a third programmable floating-gate transistor configurable to provide a reference voltage.

FIG. 8 is a partial block and partial schematic diagram of a circuit 800 including the circuit 700 of FIG. 7 and including a third programmable floating-gate transistor 802 configurable to provide a reference voltage. In particular, transistor 802 replaces resistor 118 to provide a programmable reference. Transistor 802 includes a drain electrode connected to the node ($V_B$) 604 and to the gate electrodes of transistors 116 and 120. Transistor 802 further includes a gate electrode connected to the second power supply terminal through switch 808 and includes a source electrode connected to the second power supply terminal. High voltage circuit 710 can program transistor 802 using tunnel circuitry 806, such that transistor 802 has a desired threshold voltage, represented by capacitor 804, and a desired output resistance.

In a particular example, the floating-gate of transistor 802 is configurable to control conduction through transistor 802, thereby controlling a voltage level at the gate electrodes of transistors 116 and 120. Further, floating-gate transistor 802 can be adjusted to alter conduction through the transistor 802.

Figure 9:
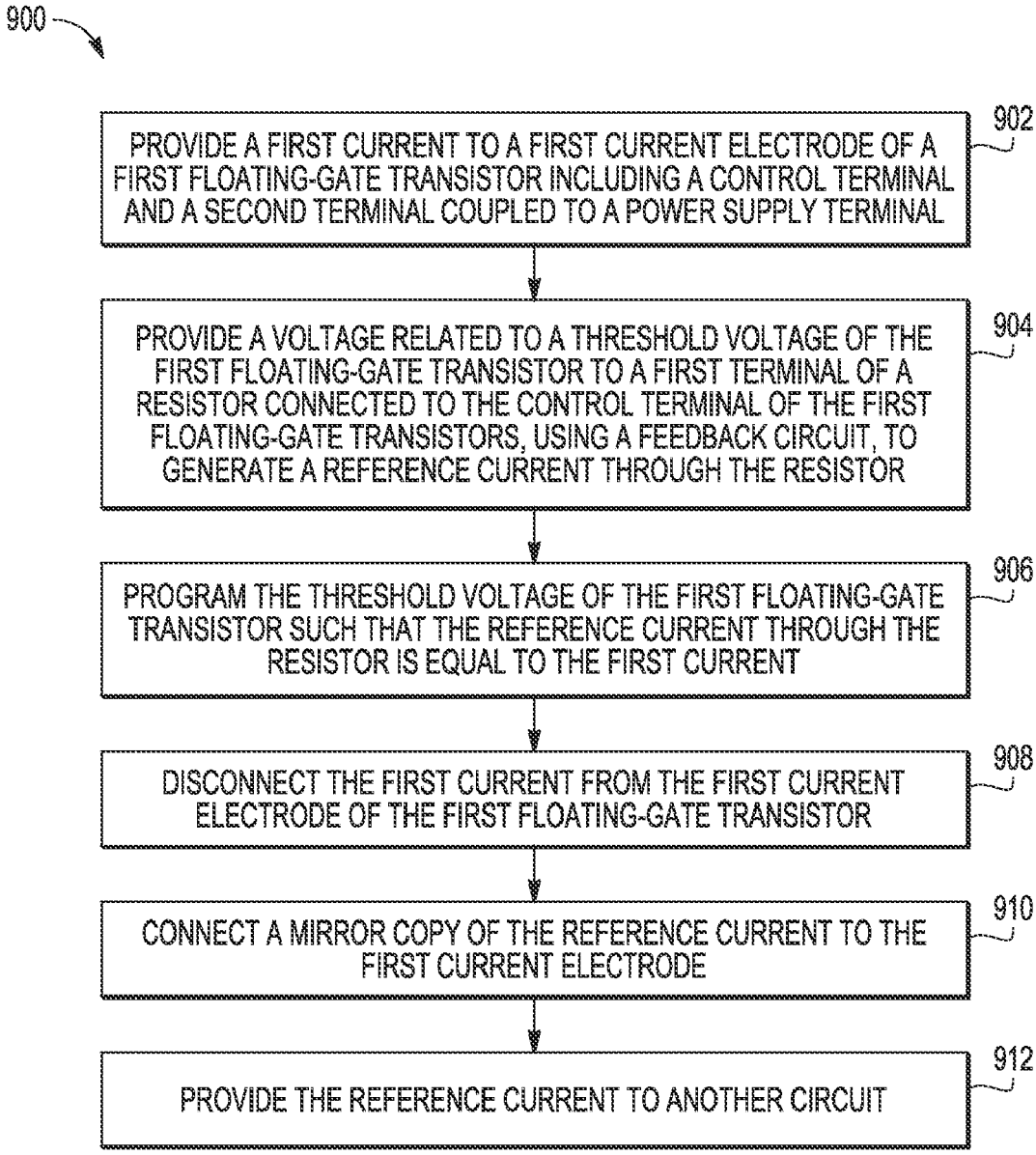
FIG. 9 is a flow diagram of an embodiment of a method of providing a reference current based on the voltage mode approach.

FIG. 9 is a flow diagram of an embodiment of a method 900 of providing a reference current. At 902, a first current is provided to a first current electrode of a first floating-gate transistor, where the first transistor includes a control terminal and a second terminal coupled to a power supply terminal.

Advancing to 904, substantially a voltage related to a threshold voltage of the first floating-gate transistor is provided to a first terminal of a resistor coupled to the control terminal of the first floating-gate transistor, using a feedback circuit, to generate a reference current through the resistor. Continuing to 906, the threshold voltage of the first floating-gate transistor is programmed such that the reference current through the resistor is equal to the first current.

Proceeding to 908, the first current is disconnected from the first current electrode of the first floating-gate transistor. Moving to 910, a mirror copy of the reference current is connected to the first current electrode. Continuing to 912, the reference current is provided to another circuit.

Figure 10:
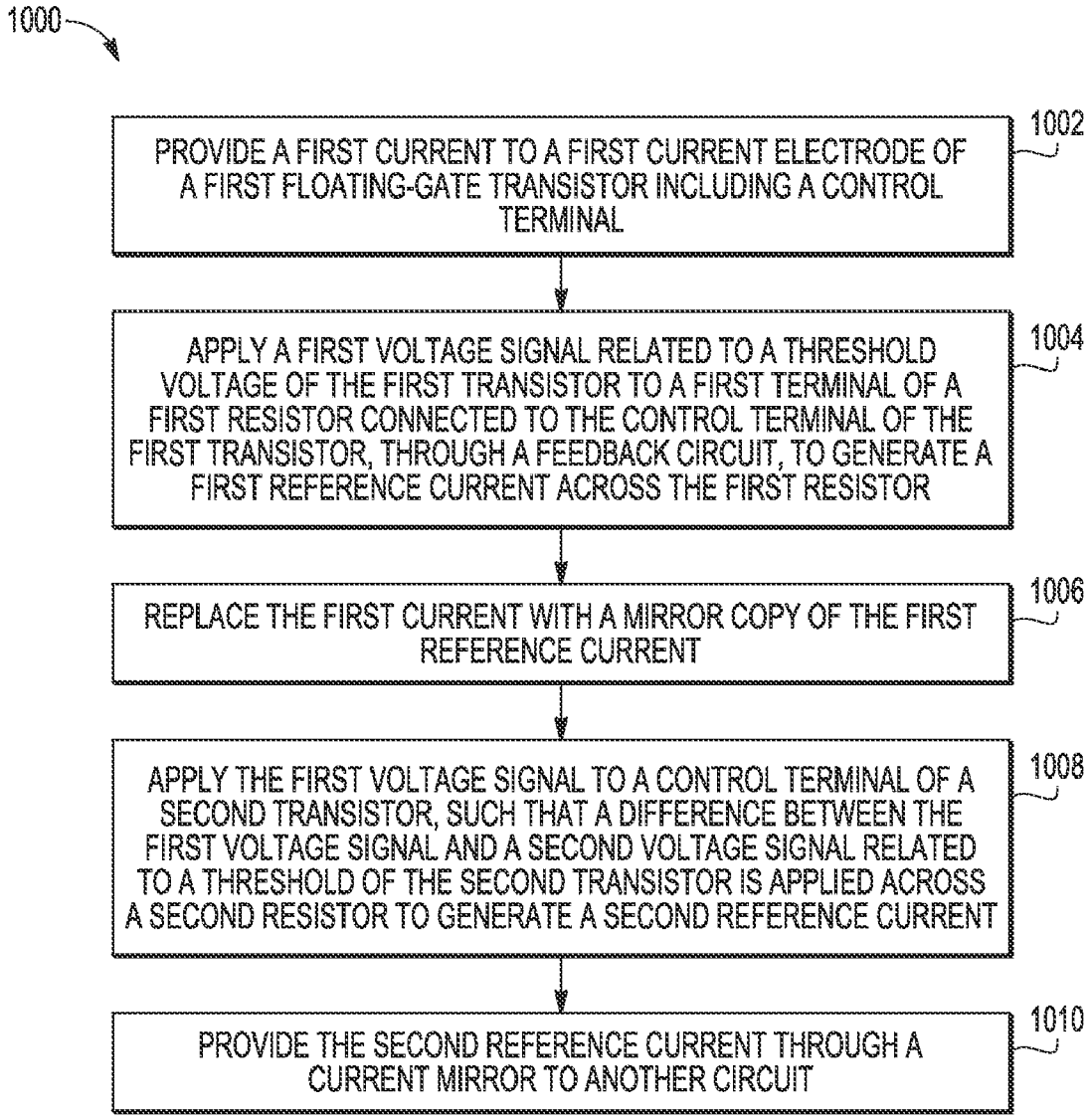
FIG. 10 is a flow diagram of an embodiment of a method of providing a reference current based on the mixed-mode approach.

FIG. 10 is a flow diagram of a second embodiment of a method 1000 for providing a reference current using a mixed-mode circuit. At 1002, a first current is provided to a first current electrode of a first transistor that includes a control terminal. Moving to 1004, a first voltage signal related to a threshold voltage of the first transistor is applied to a first terminal of a first resistor connected to the control terminal through a feedback circuit to generate a first reference current across the first resistor.

Advancing to 1006, the first current is replaced with a mirror copy of the first reference current. Continuing to 1008, the first voltage signal is applied to a control terminal of a second transistor such that a difference between the first voltage signal and a second voltage signal related to a threshold of the second transistor is applied across a second resistor to generate a second reference current. Moving to 1010, the second reference current is provided to another circuit through a current mirror.

In conjunction with the circuits and methods described above with respect to FIGS. 1-10, embodiments of reference circuits are disclosed that are configurable to provide an output reference current at a constant value across a wide range of power supply and temperature conditions. The reference circuits apply a gate-to-source voltage of a first MOS transistor across a resistor to generate a first reference current that biases the transistor through a feedback loop. A floating-gate implementation of the first transistor provides the ability to program the first reference current ($I_{REF1}$) by programming the charge stored on the floating gate. When the transistors are not floating-gate transistors, the first reference current ($I_{REF1}$) is configurable by controlling the relative sizes of the transistors and the resistance of the resistor. In some embodiments, the reference circuits also include a second MOS transistor that has the gate electrode connected to a gate electrode of the first transistor and a source electrode coupled to ground through a second resistor. A second reference current ($I_{REF}$) is generated by the difference between the gate-to-source voltages of the first and second transistors applied across the second resistor. The second reference current can be sourced or sunk through the drain electrode of the second transistor and mirrored at the output to provide an output reference current ($I_{REF}$) and/or sourced on a third resistor to generate a reference voltage $V_{REF}$. A floating-gate implementation of the second transistor provides the ability to program the second reference current ($I_2$) based on the charge stored on the floating gate. A third floating-gate transistor can replace the first resistor and/or can be used to program the first and second floating-gate transistors.

Although the present invention has been described with reference to preferred embodiments, workers skilled in the art will recognize that changes may be made in form and detail without departing from the scope of the invention.

What is claimed is:

1. A circuit comprising:

a floating-gate transistor including a first current electrode, a control electrode, and a second current electrode coupled to a power supply terminal;

a resistive element including a first terminal coupled to the control electrode of the floating-gate transistor, and a second terminal coupled to the power supply terminal; and a feedback circuit for providing a first current to the first current electrode of the floating-gate transistor, and substantially the first current to the first terminal of the resistive element, the feedback circuit having an output terminal for providing an output signal in response to a voltage at the control electrode of the floating-gate transistor.

2. The circuit of claim 1, wherein the feedback circuit comprises:

a current mirror having a first terminal coupled to the first terminal of the resistive element, and a second terminal coupled to the first current electrode of the floating-gate transistor; and a second transistor including a first current electrode coupled to the first terminal of the current mirror, a control electrode coupled to the second terminal of the current mirror, and a second current electrode coupled to the first terminal of the resistive element.

3. The circuit of claim 2, wherein the feedback circuit further comprises:

a third transistor including a first current electrode coupled to the second terminal of the current mirror, a control electrode coupled to the second terminal of the current mirror, and a second current electrode coupled to the first current electrode of the floating-gate transistor.

4. The circuit of claim 1, wherein the feedback circuit comprises:

a current mirror having a first terminal coupled to the first terminal of the resistive Element, and a second terminal coupled to the first current electrode of the floating-gate transistor;

a second transistor including a first current electrode, a control electrode coupled to the second terminal of the current mirror, and a second current electrode;

a third transistor including a first current electrode coupled to the second current electrode of the second transistor, a control electrode coupled to the first terminal of the resistive element, and a second current electrode;

a second resistive element including a first terminal coupled to the second current electrode of the third transistor and a second terminal coupled to the power supply terminal; and a second current mirror having a first terminal coupled to the first current electrode of the second transistor, and a second current electrode for providing an output reference current.

5. The circuit of claim 4, wherein the third transistor comprises a floating-gate transistor.

6. The circuit of claim 4, further comprising:

a third resistive element having a first terminal coupled to the second terminal of the second current mirror, and a second terminal coupled to the power supply voltage terminal, whereby the first terminal of the third resistor provides an output voltage.

7. The circuit of claim 1, wherein the resistive element comprises a floating-gate transistor.

8. The circuit of claim 1, wherein the resistive element comprises a configurable switched impedance.

9. A method of producing a reference current, the method comprising:

applying a voltage on a first terminal of a resistive element to generate a first current, the first terminal coupled to the control terminal of a floating-gate transistor, the resistive element including a second terminal coupled to a power supply terminal;

providing substantially the first current to a first current electrode of the floating-gate transistor, the floating-gate transistor including the control terminal and a second terminal coupled to the power supply terminal; and controlling the first current through a feedback loop that provides an output signal in response to a voltage variation at the control terminal of the floating-gate transistor.

10. The method of claim 9, further comprising:

generating a reference current related to the output signal.

11. The method of claim 10, wherein generating the reference current comprises:

mirroring the output current using a current mirror coupled to the feedback loop to generate the reference current.

12. The method of claim 9, wherein before providing the first current, the method further comprises:

programming a threshold voltage of the floating-gate transistor using a programming circuit.

13. The method of claim 12, wherein programming the threshold voltage comprises:

comparing substantially the reference current to a test current using a comparator to produce a control signal; and selectively activating a switch to couple the programming circuit to the floating-gate transistor to program the threshold voltage.

14. The method of claim 12, wherein the feedback loop includes a second transistor comprising a floating-gate transistor, and wherein, before providing the first current, the method further comprises:

programming a threshold voltage of the second transistor using a programming circuit.

15. The method of claim 14, wherein the resistive element comprises a floating-gate transistor, and wherein, before providing the first current, the method further comprises:

programming a threshold voltage of the resistive element using a programming circuit.

16. A circuit comprising:

a floating-gate transistor including a first current electrode, a control electrode, and a second current electrode coupled to a power supply terminal;

a first resistive element including a first terminal coupled to the control electrode of the floating-gate transistor, and a second terminal coupled to the power supply terminal; and a feedback circuit for providing a first current to the first current electrode of the first transistor, and for providing substantially the first current related to a voltage at the control electrode of the floating-gate transistor, through the resistive element.

17. The circuit of claim 16, wherein the floating-gate transistor has a programmable threshold voltage.

18. The circuit of claim 16, wherein the first resistive element comprises a floating-gate transistor having a programmable threshold voltage.

19. The circuit of claim 18, further comprising a programming circuit configured to program the programmable threshold voltage of the first resistive element.

20. The circuit of claim 16, further comprising:

a second transistor including a first current electrode, a control electrode coupled to the first terminal of the first resistive element, and a second current electrode; and a second resistor having a first terminal coupled to the second current electrode of the second transistor and having a second terminal coupled to the power supply terminal.

21. The circuit of claim 20, further comprising:

a current mirror having a first terminal coupled to the first current electrode of the second transistor and having a second terminal configured to carry a reference current related to the output signal.

22. The circuit of claim 20, wherein the second transistor comprises a second floating-gate transistor, and wherein the circuit includes programming circuitry comprising:

a plurality of switches;

a first tunnel circuit including a first terminal coupled to the floating-gate transistor and at least one second terminal;

a second tunnel circuit including a first terminal coupled to the second transistor and at least one second terminal;

a high voltage circuit configured to receive a control signal related to a difference between a test current and a current related to the output signal, the high voltage circuit configured to selectively control each of the plurality of switches, the first tunnel circuit, and the second tunnel circuit to selectively program at least one of the floating-gate transistor and the second transistor based on the difference.

* * * * *

UNITED STATES PATENT AND TRADEMARK OFFICE

CERTIFICATE OF CORRECTION

PATENT NO. : 8,188,785 B2
APPLICATION NO. : 12/700329
DATED : May 29, 2012
INVENTOR(S) : Radu H. Iacob et al.

It is certified that error appears in the above-identified patent and that said Letters Patent is hereby corrected as shown below:

In column 9, line 65, remove "." between "programming" and "sequence".

In column 12, line 38, replace "Element" with "element".

Signed and Sealed this
Sixth Day of November, 2012

David J. Kappos

David J. Kappos
*Director of the United States Patent and Trademark Office*